US006558524B2

(12) United States Patent
Sanada et al.

(10) Patent No.: US 6,558,524 B2
(45) Date of Patent: May 6, 2003

(54) BARREL PLATING METHOD AND APPARATUS

(75) Inventors: Yukio Sanada, Fukui (JP); Kenichi Hayashi, Fukui (JP)

(73) Assignee: Murata Manufacturing Co., Ltd., Nagaokakyo (JP)

( * ) Notice: Subject to any disclaimer, the term of this patent is extended or adjusted under 35 U.S.C. 154(b) by 84 days.

(21) Appl. No.: 09/814,004

(22) Filed: Mar. 22, 2001

(65) Prior Publication Data

US 2001/0037944 A1 Nov. 8, 2001

(30) Foreign Application Priority Data

Mar. 30, 2000 (JP) ..... 2000-093878

(51) Int. Cl.[7] ..... C25D 5/00; C25D 17/06; C25D 17/00

(52) U.S. Cl. ..... 205/143; 204/213; 204/212

(58) Field of Search ..... 204/206, 207, 204/212, 213; 205/143

(56) References Cited

U.S. PATENT DOCUMENTS 1,563,041 A * 11/1925 Puriton ..... 204/214
3,099,275 A * 7/1963 Pianowski ..... 134/140
4,378,274 A * 3/1983 Childs ..... 205/143
5,698,081 A * 12/1997 Lashmore et al. ..... 204/212

FOREIGN PATENT DOCUMENTS

| | | | |
|---|---|---|---|
| DE | 195 41 231 | | 5/1997 |
| GB | 790006 A | * | 1/1958 |
| JP | 55085697 | * | 6/1980 |
| JP | 63134420 | * | 7/1986 |
| JP | 09137296 | | 5/1997 |

* cited by examiner

*Primary Examiner*—Nam Nguyen
*Assistant Examiner*—Erica Smith-Hicks
(74) *Attorney, Agent, or Firm*—Burns, Doane, Swecker & Mathis, LLP

(57) ABSTRACT

A plating barrel includes a rotatable barrel of which the exterior shape is approximately a hexagonal column, cathode-lead connections which penetrate through end surfaces of the barrel generally along a rotational axis of the barrel, cathodes placed inside the barrel and which are connected to the ends of the cathode-lead connections, and attachments which are attached to the cathode-lead connections or the barrel in a manner such that the central axes of the attachments are approximately the same as the rotational axis of the barrel, the vertices of the attachments point toward the center of the barrel, and peripheral portions of the bases of the attachments at the opposite ends relative to the vertices are close to the inside end surfaces of the barrel so that objects do not pass through the gaps.

15 Claims, 3 Drawing Sheets

BARREL PLATING METHOD AND APPARATUS

This application claims priority under 35 U.S.C. §§ 119 and/or 365 to Japanese Patent Application No. 2000-093878 filed in Japan on Mar. 30, 2000; the entire content of which is hereby incorporated by reference.

BACKGROUND OF THE INVENTION

1. Field of the Invention

The present invention relates to plating equipment, and more specifically relates to a plating barrel for plating objects such as electronic devices, etc., by immersing a barrel containing the objects into a plating solution and by applying a current.

2. Description of the Related Art

A plating barrel is used for plating a metal layer onto objects such as electric components. FIG. 4 is a schematic view of an example of a plating barrel of the conventional type.

This plating equipment comprises a barrel 21 which includes a part constructed of a mesh screen, etc., for allowing a plating solution to pass through, and cathodes 22 are placed in the interior of the barrel 21. First, a quantity of objects (not shown) such as multilayer ceramic capacitors and conducting media (not shown) such as steel balls are placed in the barrel 21. Then the barrel 21 is immersed into a plating solution 24 contained in a plating bath 23. Then, a current is applied between an anode 25 which is placed into the plating solution 24 and the cathodes 22, which are placed inside the barrel 21, while the barrel 21 is rotated in the plating solution 24. Accordingly, the objects are brought into contact with the plating solution 24 and the cathodes 22 via the conductive media, and are plated.

In the above-described plating barrel of the conventional type, the objects and the conductive media tumble inside the barrel 21 due to the rotation of the barrel 21. However, since the end surfaces 21*a* of the barrel 21 are flat and are vertical, the objects tend to accumulate at the end surfaces 21*a* so that the objects are no longer in contact with the conductive media. Thus, there is a problem where the thickness of the plating layers on the objects has a large variation.

In addition, cathode-lead connections 26 for connecting to the cathodes 22 in the barrel 21 have generally horizontal portions, which allows the objects to piled up on top of the cathode-lead connections 26. This causes another problem where the objects on the cathode-lead connections 26 may not be plated at all, and plating defects may occur.

SUMMARY OF THE INVENTION

The present invention aims to solve the above-mentioned problems. Accordingly, an object of the present invention is to provide a plating barrel which prevents the objects from piling up or stopping in order to avoid the occurrence of plating defects, and which reliably forms a plated layer having uniform thickness on each of the objects.

To attain the above-described object, a plating barrel according to one aspect of the present invention comprises a barrel which is rotatable, has an approximately cylindrical shape, and contains objects inside it, at least one cathode-lead connection which penetrates through the end surface of the barrel along the rotational axis of the barrel and which is supported in a manner such that the cathode-lead connection is rotatable relative to the barrel, at least one cathode which is placed inside the barrel and which is connected to the end of the cathode-lead connection, and at least one either conical or pyramidal attachment which is attached to the cathode-lead connection, in a manner such that the central axis of the attachments are the same as the rotational axis of the barrel, the vertices of the attachments point to the center of the barrel, and peripheral portions of the bases of the attachments at the opposite ends relative to the vertices are in proximity to the inside end surfaces of the barrel, so that the objects do not pass through the gaps between the bases and the inside end surfaces of the barrel. Thus, the piling up or stopping of the objects is avoided or prevented, so that a layer having a uniform thickness is reliably formed on each of the objects and plating defects are prevented.

In order to avoid and prevent the objects from piling up, the conical or pyramidal attachments preferably have vertices having an angle q (see FIG. 1) which is larger than 90°, so as to be an obtuse angle.

In the present invention, there are no restrictions regarding the actual shape of the attachments. The attachments may be exactly conical or pyramidal; or, the shape of the attachments may be modified somewhat. For example, the vertices of the attachments may be rounded, or they may be flattened to form a trapezoidal cross-section cone.

A plating barrel according to another aspect of the present invention comprises a barrel which is rotatable, has an approximately cylindrical shape, and contains objects inside it, at least one cathode-lead connection which penetrates through the end surface of the barrel along the rotational axis of the barrel and which is supported in a manner such that the cathode-lead connection is rotatable relative to the barrel, at least one cathode which is placed inside the barrel and which is connected to the end of the cathode-lead connection, and at least one either conical or pyramidal attachment which is attached to the barrel in a manner such that the central axes of the attachments are the same as the rotational axis of the barrel, the vertices of the attachments point toward the center of the barrel, and peripheral portions of the bases of the attachments at the opposite ends relative to the vertices are in contact with or in proximity to the inside end surfaces of the barrel, so that the objects do not pass through the gaps between the bases and the inside end surfaces of the barrel. Thus, from piling up or stopping of the objects is avoided or prevented, so that a layer having a uniform thickness is reliably formed on each of the objects and plating defects are prevented.

Since the conical or pyramidal attachment is attached to the barrel, the attachment rotates along with the barrel, so that the piling up or stopping of the objects is more effectively avoided or prevented.

A major part of the cathode-lead connection is preferably placed in the lower section of the barrel, i.e., below the rotational axis of the barrel.

When the major part of the cathode-lead connection is placed at a lower section of the barrel relative to the rotational axis of the barrel, the objects which pile up in the lower section of the barrel effectively contact the cathodes, which enhances the effectiveness of the present invention.

The conical or pyramidal attachment preferably covers nearly all of the horizontal portion of the cathode-lead connection so as not to expose the generally horizontal portion inside the barrel.

Since the conical or pyramidal attachment covers the generally horizontal portion of the cathode-lead connection so as not to expose the esentially horizontal portion inside the barrel, the objects cannot pile up on the generally horizontal portions of the cathode-lead connections.

Accordingly, plating defects in which the objects are not completely plated with uniform thickness layers are effectively prevented.

DESCRIPTION OF THE PREFERRED EMBODIMENT

Figure 1:
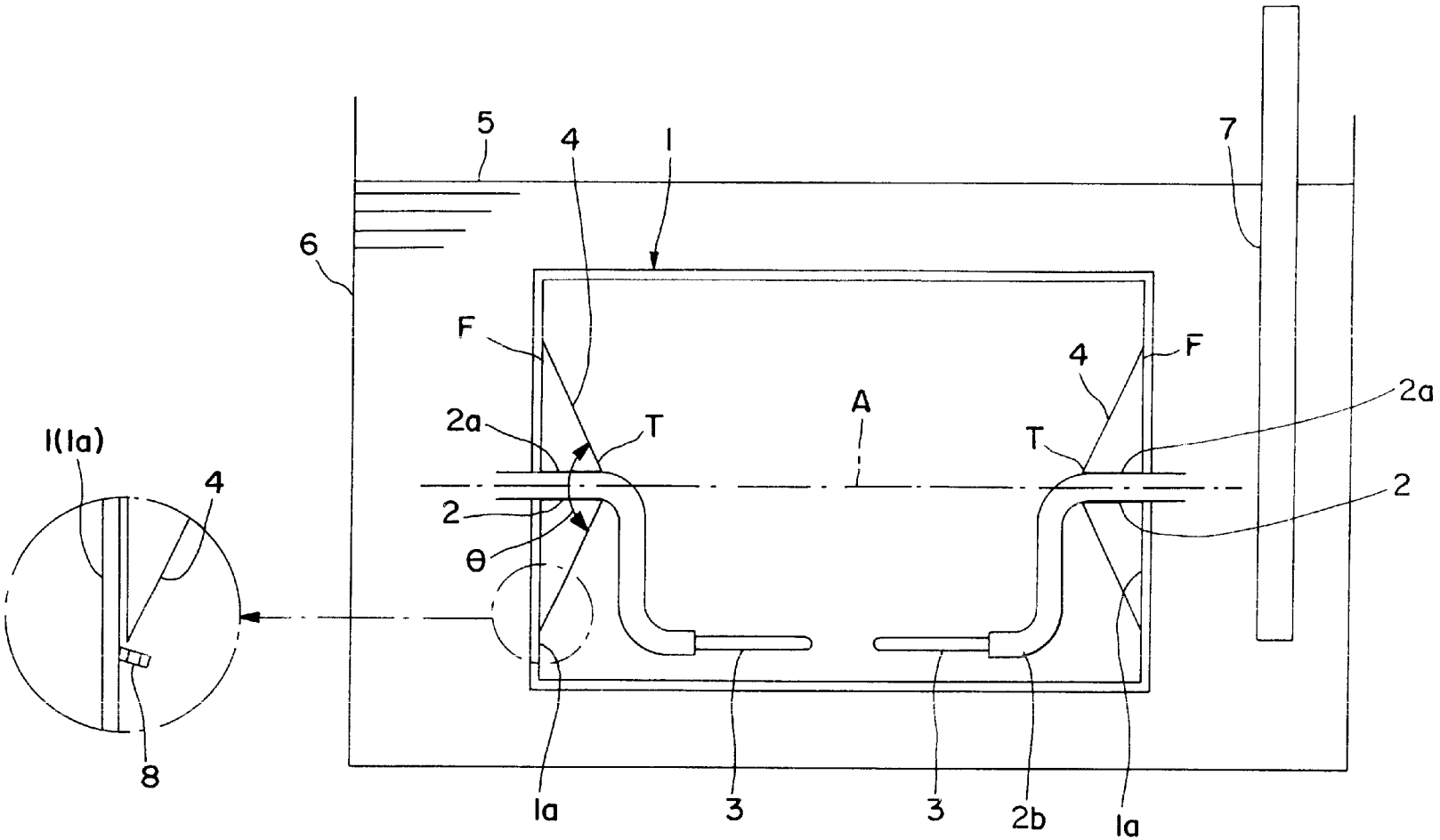
FIG. 1 is a schematic representation of a plating barrel according to an embodiment of the present invention.

Characteristics of the present invention will be described in detail in conjunction with the following embodiments. FIG. 1 is a schematic view of a plating barrel according to an embodiment of the present invention.

Embodiment 1

Figure 2:
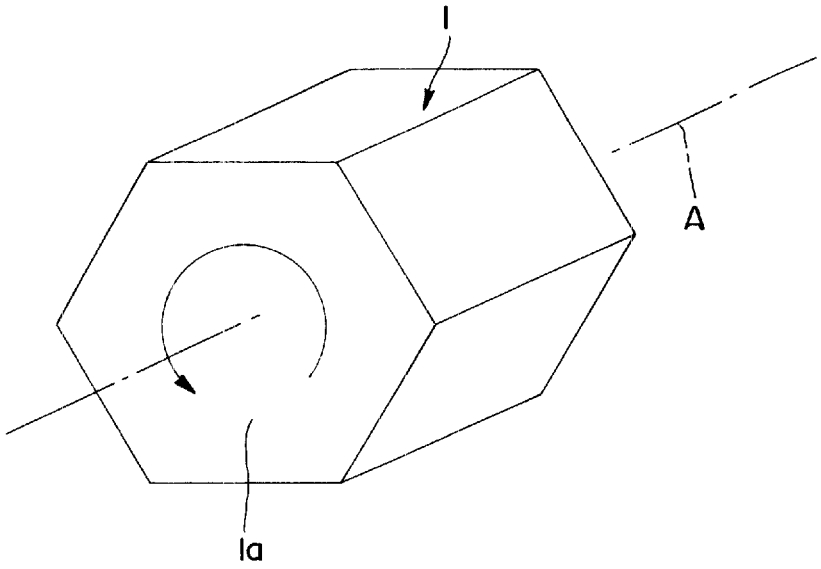
FIG. 2 is a perspective view of a barrel included in the plating barrel shown in FIG. 1.

Referring to FIG. 1, the plating barrel includes a rotatable barrel 1 with the exterior shape approximately like a hexagonal column as shown in FIG. 2, cathode-lead connections 2 which passes through the end surfaces 1*a* of the barrel 1 along the rotational axis A of the barrel 1, cathodes 3 which are placed inside the barrel 1 and which are connected to the end of the cathode-lead connections 2, and conical attachments 4 which are attached to the cathode-lead connections 2 in a manner such that the central axes of the attachments are approximately the same as the rotational axis of the barrel 1, the vertices T of the attachments point toward the center of the barrel 1, and peripheral portions F of the bases of the attachments at the opposite ends relative to the vertices T are in proximity to the inside end surfaces 1*a* of the barrel 1 so that objects 8 do not pass in between the gaps.

In addition, the plating barrel includes a plating bath 6 which is filled with a plating solution 5 and an anode 7 which is placed inside the plating bath 6.

The barrel 1 includes a part constructed of a mesh screen, etc., for allowing the plating solution to pass through.

At least the surfaces of the cathode-lead connections 2 are constructed of an insulating material. In addition, the cathode-lead connections 2 are supported in a manner such that the cathode-lead connections 2 are rotatable relative to the barrel 1. More specifically, the cathode-lead connections 2 are stationary while the barrel 1 rotates around the cathode-lead connections.

The cathodes 3 and a major portion 2*b* of the cathode lead connection are placed below the rotational axis A of the barrel 1 so that the objects which pile up in the lower section of the barrel 1 effectively contact the cathodes 3.

In addition, the conical attachments 4 cover generally horizontal portions 2*a* of the cathode-lead connections 2 so as not to expose the horizontal portions 2*a* inside the barrel 1; the objects therefore do not pile up on the horizontal portions 2*a*.

According to the plating barrel of a preferred embodiment, the volume of the barrel 1 is 8 liters. Thus, barrel 1 has sufficient capacity to receive 1.5 liters of steel balls having a diameter of 1.5 mm, and 0.5 liters of multilayer ceramic capacitors having dimensions of 2 mm by 1.25 mm as the objects.

Embodiment 2

Figure 3:
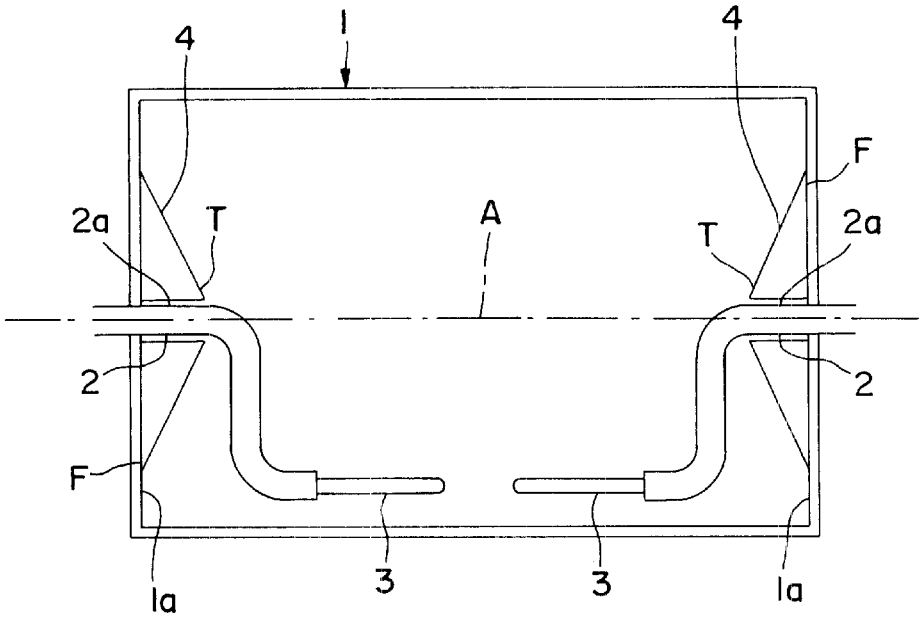
FIG. 3 is a schematic view of a plating barrel according to another embodiment of the present invention.

FIG. 3 is a schematic representation showing a construction of a major part of a plating barrel according to another embodiment (Embodiment 2) of the present invention.

In the plating barrel according to the above-described Embodiment 1, the conical attachments 4 were attached to the cathode-lead connections 2. In Embodiment 2, however, the conical attachments 4 are attached to the inside end surfaces 1*a* of the barrel 1, as shown in FIG. 3. The conical attachments 4 are attached to the inside end surfaces 1*a* of the barrel 1 in a manner such that the peripheral portions F of the bases of the attachments are in contact with the inside end surfaces 1*a* of the barrel 1. More specifically, there are no gaps between the conical attachments 4 and the inside end surfaces 1*a* of the barrel 1.

Constructions of other parts of the plating barrel are similar to those in Embodiment 1, so that explanations are omitted to avoid repetition.

Example of barrel plating

The plating barrels according to Embodiments 1 and 2 are used to plate Ni, and then to plate Sn over Ni, under the following conditions.

| | |
|---|---|
| 1. Volume of steel balls: | 1.5 liters |
| 2. Volume of objects: | 0.5 liters |
| 3. Ni plating bath: | Watt's bath |
| 4. Sn plating bath: | neutral Sn plating bath |
| 5. Current density at cathodes | |
| During Ni plating: | 0.2 A/dm2 |
| During Sn plating: | 0.1 A/dm2 |
| 6. Time period for plating | |
| Ni plating: | 60 min |
| Sn plating: | 60 min |

Evaluation

With regard to objects (multilayer ceramic capacitors) which are processed with Ni plating and Sn plating using the above-described conditions, the thickness of Sn-plating layers were measured to determine the degree of variation (coefficient of variation, CV (%)). In addition, the number of plating defects where the objects was not completely plated was also determined.

The number of specimens used for measuring the thickness of the Sn-plated layers was n=50, and the number of specimens used for determing the rate of the plating defects was n=2,000,000.

The results of the test measuring the thicknesses of Sn-plated layers and the degree of variation and the visual inspection to determine the rate of the plating defects are shown in Table 1.

TABLE 1

| | Attachments | Thickness of Sn layer (*m) | Variation CV (%) | Plating Defects (parts per million) |
|---|---|---|---|---|
| Conventional type | None Used | 2.43 | 18.5 | 12 |
| Embodiment 1 | Attached to cathode-lead connections | 2.56 | 7.8 | 2 |
| Embodiment 2 | Attached to barrel | 2.37 | 8.2 | 0 |

Figure 4:
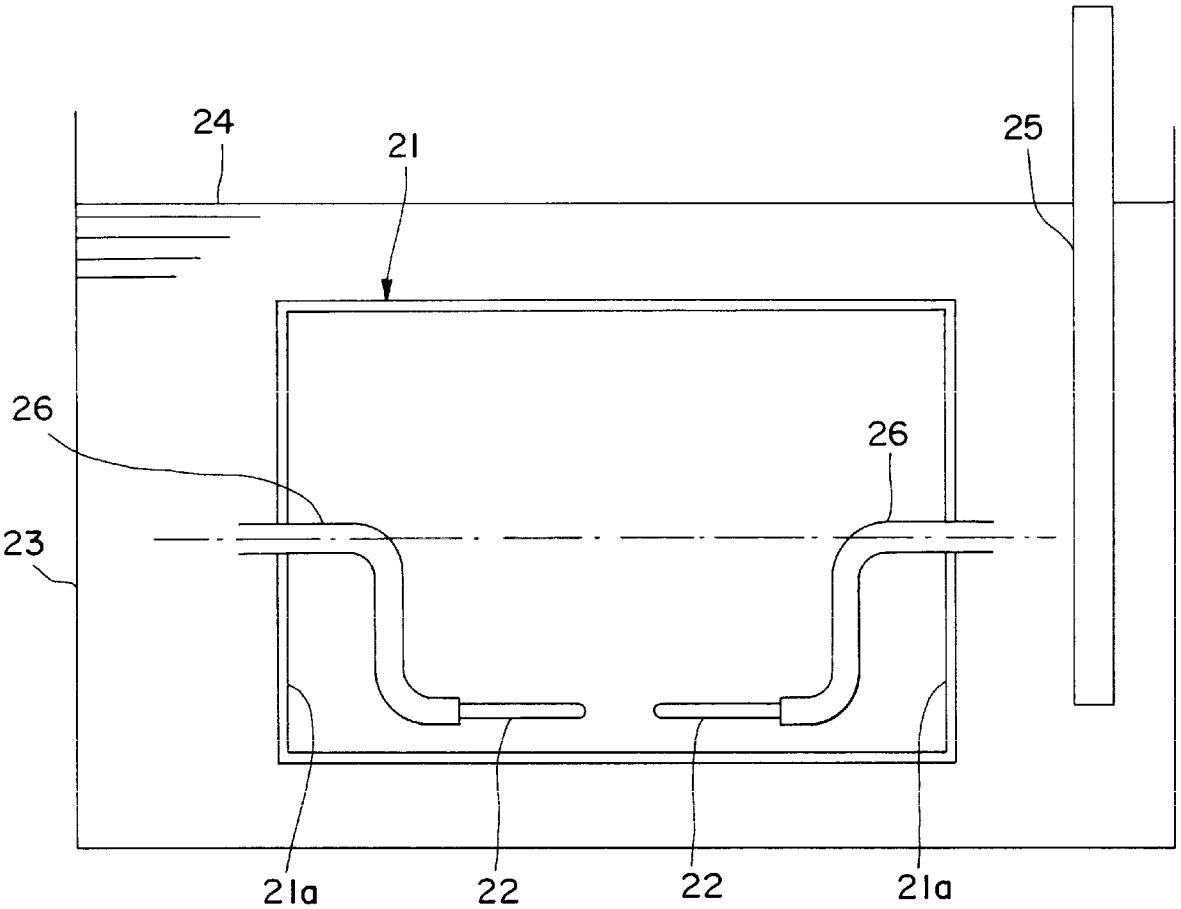
FIG. 4 PRIOR ART
FIG. 4 is a schematic view of a plating barrel of the conventional type.

For the purpose of comparison, the plating of Ni and Sn was also performed by using the conventional plating barrel shown in FIG. 4 under the same conditions. The thickness of Sn-plated layers were measured to determine the degree of variation (CV (%)), and the number of plating defects was also determined. The results are also shown in Table 1.

With reference to Table 1, variation (CV) of the thickness of the Sn layers plated by using the conventional plating barrel was 18.5%, which was relatively high. In contrast, the result of CV calculation when the plating barrel of Embodiment 1 was used was 7.8%, and the result of CV calculation when the plating barrel according to Embodiment 2 was used was 8.2%. Accordingly, both plating barrels of Embodiment 1 and Embodiment 2 provided lesser variation than the conventional type.

In addition, when the conventional plating barrel was used, the rate of the plating defects was 12 parts per million (ppm). In contrast, the rate of the plating defects when the plating barrel of Embodiment 1 was used was 2 ppm, and the rate of the plating defects when the plating barrel of Embodiment 2 was used was 0 ppm. Thus, the plating barrel of Embodiments 1 and 2 yielded significantly lower defect rates. The reason such a particularly low rate was achieved by the plating barrel of Embodiment 2 was that the conical attachments 4 were attached to the inside end surfaces 1*a* of the barrel 1 and were rotated along with the barrel 1. It is believed that such a construction more effectively prevented accumulation as the objects tumbled, yielding the lower rate of the plating defects.

In the descriptions above, the objects were described as being the multilayer ceramic capacitors. The present invention, however, is not limited to this. The present invention may also be applied to various kinds of objects, such as ceramic electronic resistors and inductors and other components.

In addition, although the attachments were described to be conical in the descriptions above, pyramidal attachments may also be used to obtain the same effects as in the above-described embodiments. Also, although Embodiments 1 and 2 were described as including attachments 4 at each end of the barrel 21, an attachment may be provided only at a single end of the barrel, if desired or necessary.

Furthermore, the present invention is also not limited to the above-described embodiments in other ways. Various modifications are possible within the scope of the present invention due to the specific shape and construction of the barrel, the shape and construction of the cathode-lead connections and the cathodes, the specific shape and construction of the conical or pyramidal attachments, method of attaching the conical or pyramidal attachments, etc.

What is claimed is:

1. A method of plating objects, comprising:

attaching an attachment having a vertex portion and a base portion relative to an inside end surface of a barrel of a plating barrel, the base portion being larger than the vertex portion, the barrel being rotatable about a rotational axis and including an interior adapted to receive objects, such that the base portion is placed sufficiently proximate the inside end surface so that the objects do not pass through any gaps between the base portion and the end surface of the barrel;

placing objects in the barrel; and plating the objects, wherein the attachment is attached to a cathode-lead connection extending through the end surface of the barrel, and a major part of the cathode-lead connection is placed below the rotational axis of the barrel.

2. The method according to claim 1, wherein the attachment is attached to the barrel.

3. The method according to claim 1, wherein an attachment is attached relative to each of two opposing inside end surfaces of the barrel.

4. A plating barrel comprising:

a barrel that is rotatable about a rotational axis, has an approximately cylindrical shape, and includes an interior adapted to receive objects;

at least one cathode-lead connection, the at least one cathode-lead connection extending through an end surface of the barrel generally along the rotational axis of the barrel and being rotatable relative to the barrel;

at least one cathode placed inside the barrel and connected to the end of at least one cathode-lead connection; and at least one attachment attached to at least one cathode-lead connection, the attachment having a central axis extending generally along the rotational axis of the barrel between a vertex portion of the attachment and a base portion of the attachment, the base portion being larger than the vertex portion, the vertex portion pointing toward a center of the barrel, and the base portion being placed sufficiently close to an inside end surface of the barrel so that the objects do not pass through any gaps between the base portion and the inside end surface of the barrel, wherein a major part of the cathode-lead connection is placed below the rotational axis of the barrel.

5. A plating barrel according to claim 4, wherein the at least one attachment covers a horizontal portion of the cathode-lead connection so that the horizontal portion is not exposed inside the barrel.

6. A plating barrel according to claim 4, wherein the at least one cathode-lead connection includes two cathode-lead connections, each of the cathode-lead connections extending through opposing end surfaces of the barrel substantially along the rotational axis of the barrel and being rotatable relative to the barrel, a cathode is connected to the end of each of the cathode-lead connections, and an attachment is attached to each of the cathode-lead connections.

7. A plating barrel, according to claim 4, wherein the at least one attachment is conical in shape.

8. A plating barrel according to claim 4, wherein the at least one attachment is pyramidal in shape.

9. A plating barrel according to claim 4, wherein the barrel is shaped as a hexagonal column.

10. A plating barrel comprising:

a barrel that is rotatable about a rotational axis, has an approximately cylindrical shape, and includes an interior adapted to receive objects;

at least one cathode-lead connection, the at least one cathode-lead connection extending through an end surface of the barrel generally along the rotational axis of the barrel and being rotatable relative to the barrel;

at least one cathode placed inside the barrel and connected to the end of the at least one cathode-lead connection; and at least one attachment attached to the barrel, the at least one attachment having a central axis extending substantially along the rotational axis of the barrel between a vertex portion of the attachment and a base portion of the attachment, the base portion being larger than the vertex portion, the vertex portion pointing toward a center of the barrel, and the base portion being placed sufficiently close to an inside end surface of the barrel so that the objects do not pass through any gaps between the base portion and the inside end surface of the barrel, wherein a major part of the cathode-lead connection is placed below the rotational axis of the barrel.

11. A plating barrel according to claim 10, wherein the at least one attachment covers a horizontal portion of the cathode-lead connection so that the horizontal portion is not exposed inside the barrel.

12. A plating barrel according to claim 10, wherein the at least one cathode-lead connection includes two cathode-lead connections, each of the cathode-lead connections extending through opposing end surfaces of the barrel substantially along the rotational axis of the barrel and being rotatable relative to the barrel, a cathode is connected to the end of each of the cathode-lead connections, and an attachment is attached to each of the cathode-lead connections.

13. A plating barrel according to claim 10, wherein the at least one attachment is conical in shape.

14. A plating barrel according to claim 10, wherein the at least one attachment is pyramidal in shape.

15. A plating barrel according to claim 10, wherein the barrel is shaped as a hexagonal column.

* * * * *